US006572187B2

(12) United States Patent
Laufer

(10) Patent No.: US 6,572,187 B2
(45) Date of Patent: Jun. 3, 2003

(54) QUICK RELEASE ANCHORING SYSTEM FOR ENGAGEMENT OF A SEAT ASSEMBLY TO A FIXED CONSOLE

(75) Inventor: Steve A. Laufer, Miami, FL (US)

(73) Assignee: Pinnacle Furnishings, Inc., Miami, FL (US)

( * ) Notice: Subject to any disclaimer, the term of this patent is extended or adjusted under 35 U.S.C. 154(b) by 0 days.

(21) Appl. No.: 09/733,262

(22) Filed: Dec. 11, 2000

(65) Prior Publication Data

US 2002/0070589 A1 Jun. 13, 2002

(51) Int. Cl.[7] ..... A47C 7/56
(52) U.S. Cl. ..... 297/217.1; 297/331; 297/217.7
(58) Field of Search ..... 297/331, 337, 297/217.1, 217.7; 292/304

(56) References Cited

U.S. PATENT DOCUMENTS 3,915,493 A * 10/1975 Brown ..... 296/63
4,667,917 A * 5/1987 Takace ..... 248/398
4,805,952 A * 2/1989 Coleman ..... 296/65.03
4,840,343 A * 6/1989 Gasser ..... 248/500
5,083,738 A * 1/1992 Infanti ..... 248/500
5,487,588 A * 1/1996 Burleigh et al. ..... 297/253
5,662,368 A * 9/1997 Ito et al. ..... 296/65.05
D384,983 S * 10/1997 Chmelicek et al. ..... D21/370
5,938,286 A * 8/1999 Jones et al. ..... 297/378.12
6,082,819 A * 7/2000 Jackson ..... 297/253
6,047,940 A * 8/2000 Kaplan ..... 248/501

* cited by examiner

*Primary Examiner*—Peter M. Cuomo
*Assistant Examiner*—Joseph Edell

(57) ABSTRACT

An anchoring system for releasably engaging a seat assembly to a fixed console of a work or gaming station, such as typically found in casinos and game rooms. A set of complimentary, interlocking components is provided wherein one member of each set is affixed to the chair assembly, and the companion member of each such set is affixed to the fixed console of a gaming station. Each of the complimentary members of the interlocking components is located on the chair assembly and console of the fixed station, respectively, so that when engaged, each of the chair assembly and fixed station is properly aligned relative to one another, and the chair assembly has been effectively immobilized relative to its position vis-à-vis the fixed station.

9 Claims, 4 Drawing Sheets

QUICK RELEASE ANCHORING SYSTEM FOR ENGAGEMENT OF A SEAT ASSEMBLY TO A FIXED CONSOLE

FIELD OF THE INVENTION

This invention relates a device and to a method. More specifically, this invention is directed to a chair anchoring assembly, for releasable engagement of a chair assembly to a fixed/stationary console, such as the console of a gaming machine or work station. In one of the preferred embodiments of this invention, the chair assembly comprises a chair mounted to a sled or support base where the sled or support base equipped with a quick release anchoring system for releasably locking the sled or support base in a desired position relative to the fixed station.

BACKGROUND OF THE INVENTION

In a commercial environment entertainment, including specifically, a gaming room or casino, customer comfort and safety are paramount to a successful business enterprise. Where customer enthusiasm or displeasure can result from such gaming activities, it is important to insure that the gaming station is both secure from erratic patron behavior and yet serviceable (e.g. comfortable, attractive, etc.). In order to accommodate these multiple objectives, gaming room operators require that the seating accommodations associated with such gaming stations be secured to the a fixed support, preferably to the fixed/stationary console of gaming station. Accordingly, a number of designs have been proposed and implemented which purport to meet these dual objectives. The following patents are representative of a number of these design alternatives.

U.S. Pat. No. 5,102,192 (to Barile, issued Apr. 7, 1992) discloses a detachable anchoring device for a seat assembly attached through a support member to a substantially planar support base or sled. The Barile device includes a quick release connector assembly for releasably connecting the planar base in a desired position with respect to a fixed station. The quick release connector assembly includes a cooperating bracket connected to a machine or service counter, and a connecting member for releasably connecting a first portion of the support base or sled to the bracket. The cooperating bracket and connecting member, which provide the operative means of the detachable anchoring device, can include a releasable locking member for preventing inadvertent disengagement of the operative means of the device, (See for example FIGS. 6, 7 & 8).

U.S. Pat. No. 5,542,748 (to Barile, issued Aug. 6, 1996) discloses a detachable anchoring device for a seat assembly attached through a support member to a substantially planar support base or sled. Unlike the Barile '192 configuration discussed above, the configuration of Barile '748 provides for positive interlocking of each of the complimentary brackets on each of the seat assembly and to the fixed gaming station without an additional locking member. The Barile '748 device accomplishes this objective by providing complimentary brackets to engage each other upon installation of the chair assembly at the gaming station, (See for example FIGS. 5–7).

U.S. Pat. No. 5,791,731 (to Infanti, issued Aug. 11, 1998) discloses a detachable anchoring device for a seat assembly attached through a support member to a substantially planar support base or sled. The Infanti '731 device includes a number of alternative means for securing the engagement of his seat assembly to a fixed gaming station. The various contrivances disclosed by Infanti include locking pins (FIG. 25) and hinged latching members (FIG. 32).

As is evident from the foregoing abbreviated review of the prior art, the devices used to releasably anchor a seat assembly to a fixed console of a gaming station can involve relatively elaborate and intricate designs; and, in certain instances, may require skillful installation, further complicating the performance of routine maintenance tasks, and unnecessary expense. Accordingly, there continues to exist a need for an inexpensive, simple device that can releasably engage a seat assembly to a fixed console of a gaming station.

SUMMARY OF THE INVENTION

The above and related objects are achieved by providing an anchoring system for releasably engaging a seat assembly to a fixed station, or gaming station, such as typically found in casinos and game rooms. In the system of this invention, a set of complimentary, interlocking components is provided wherein one member of each set is affixed to the chair assembly, and the companion member of each such set affixed to the fixed console of a gaming station. Each of the complimentary members of the interlocking components is located on the chair assembly and console of the fixed station, respectively, so that when engaged, each of the chair assembly and fixed station is properly aligned relative to one another, and the chair assembly has been effectively immobilized relative to its position vis-à-vis the fixed station.

In one of the preferred embodiments of this invention, the set of complimentary, interlocking components resembles a simple hinge. More specifically, one member of the set of interlocking components comprises an assembly having a pin or bolt disposed on a mounting bracket that can be affixed to the base of seat assembly; and the other member of the set of interlocking components comprises a latch for engagement of the pin. More specifically, the orientation of this pin or bolt on this mounting bracket is designed to position this pin or bolt along a horizontal plane, and at right angles, to a latch assembly that is mounted on the fixed console of a gaming station. The latch assembly is oriented in receiving relationship to the horizontally disposed pin. Thus, as the seat assembly is positioned relative to the console of a fixed gaming station, the pin on the seat assembly engages the latch assembly. This latch assembly comprises a mounting bracket and a frame-like housing having an open ramp. The open ramp has a riser which extends from the open end of the ramp to a snare for engaging the pin. The latch assembly is further provided with a pivotally mounted brake to retain the pin within the snare.

In one of the preferred embodiments of this invention, one member of a pair of complimentary members is mounted on a single bracket, and the bracket affixed directly to the gaming station. In another of the preferred embodiments of this invention, one or both of the complimentary components of the interlocking anchoring device can be formed or molded into either of the seat assembly or the fixed console of a gaming station, or provided as independent components for retrofitting existing gaming stations.

It is thus the principal object of this invention to provide an anchoring device for a seat assembly designed to releasably engage such assembly to a fixed console of a gaming station.

It is another object of this invention to provide an anchoring device which includes a set of complimentary, interlocking components, wherein one member of each set is affixed to the chair assembly, and the companion member of each such set affixed to the fixed console of a gaming station.

It is yet another object of this invention to provide an anchoring device which includes means for engagement of the seat assembly to the fixed gaming station without tools or modification of either the seat assembly or gaming station.

It is still yet another object of this invention to provide an anchoring device which includes means for pivotal engagement of the seat assembly about the fixed gaming station so as to permit cantilever raising and lowering of the seat assembly, for cleaning and maintenance, without having to disengage the seat assembly from the gaming station.

It is but still another object of the present invention to provide an anchoring device which includes means for engagement of the seat assembly to the fixed gaming station so as to inhibit removal of the seat assembly from the fixed gaming station.

Additional objects of this invention include a method for securing a seat assembly to a gaming station and the resulting ensemble.

DETAILED DESCRIPTION OF THE INVENTION INCLUDING PREFERRED EMBODIMENTS

The anchoring system of this invention is described and illustrated herein with reference to a game room or casino gaming station. It is understood that such reference and description thereof relative to this specific environment is for purposes of simplicity of understanding.

Figure 1:
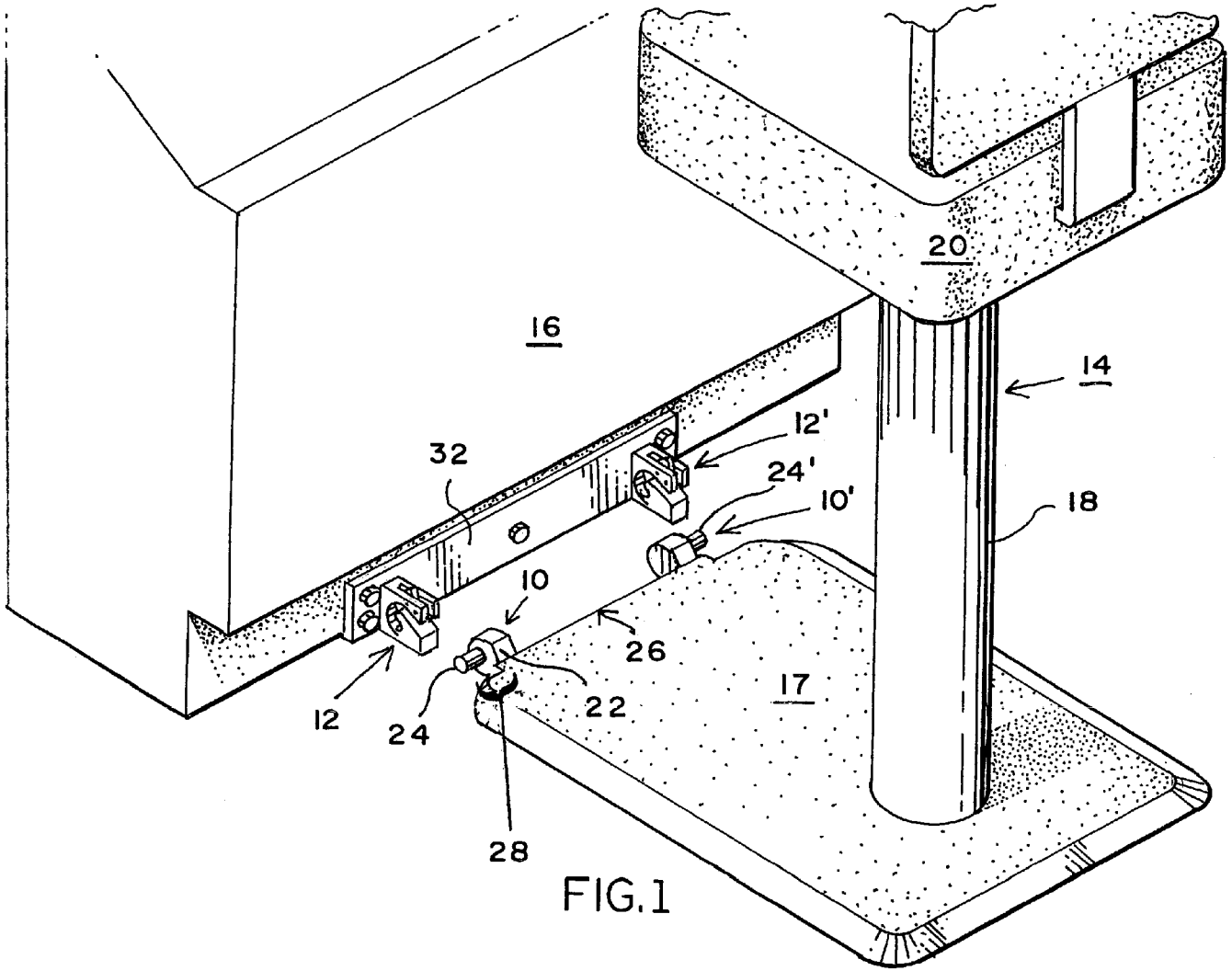
FIG. 1 is a perspective view of an anchoring system of this invention, specifically, within the context of releasably engaging a seat assembly to a fixed console o a gaming station.

The anchoring system of this invention, as shown in FIG. 1, comprises a complimentary set of component parts that releasably engage one another. In the context of this invention, these components (either one or both) can also be formed or integral to each of the furnishings that are to be united, or provided in kit form, and simply affixed to each of the furnishings, accordingly. The functional components of the complimentary set of components comprises a pin assembly (10) and a latch assembly (12). In the preferred embodiments of this invention shown in FIG. 1, the pin assembly (10) is mounted or affixed to the chair assembly (14), and the latch assembly (12) is mounted or affixed to the fixed console (16) of a gaming station (although there is no technical or physical reason why the inverse arrangement would not also be operative). The chair assembly (14) (shown only in partial section) comprises a sled base (17), a support post (18) and seat (20).

Figure 2:
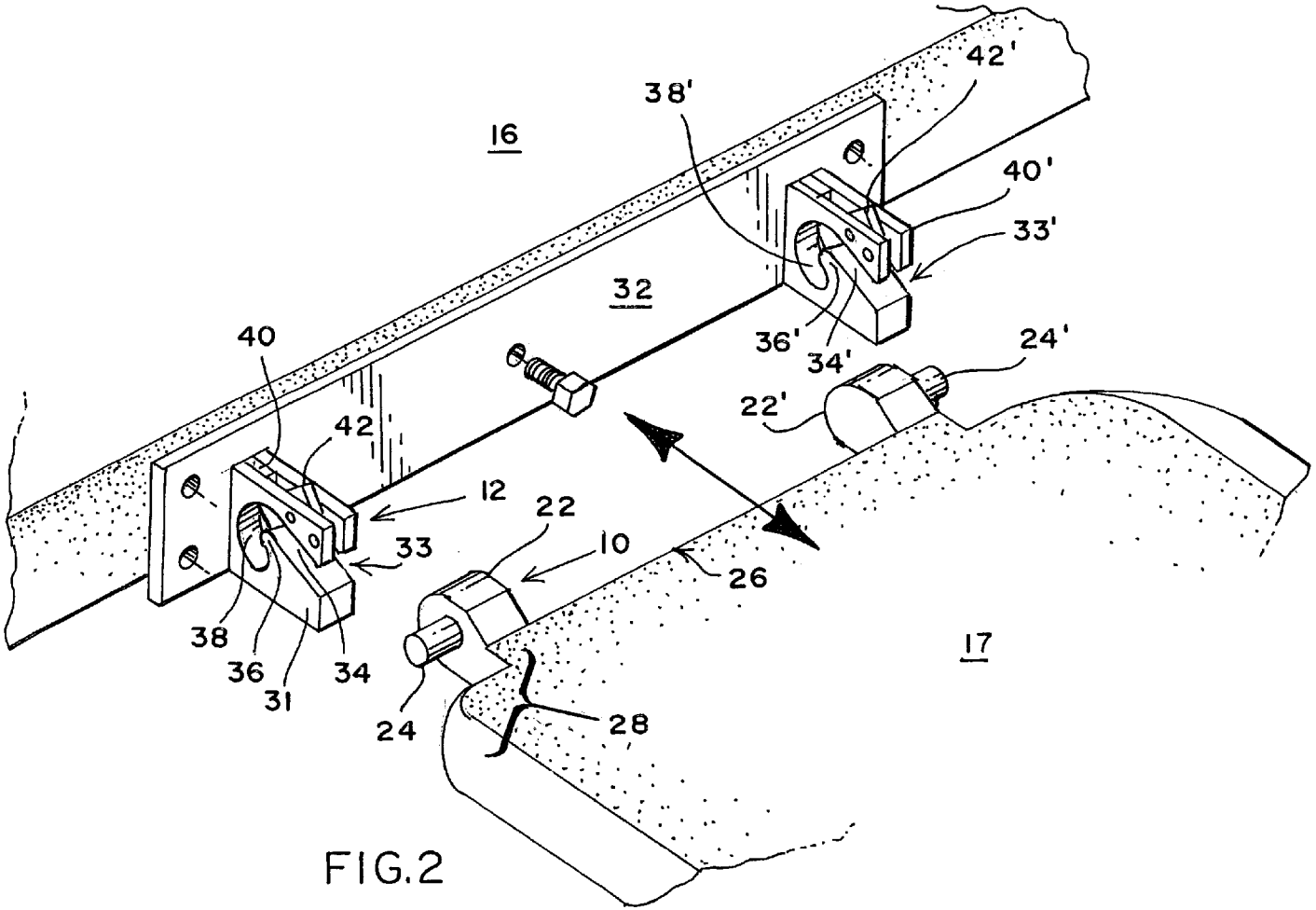
FIG. 2 is an enlarged perspective view of the anchoring system of FIG. 1.
Figure 3:
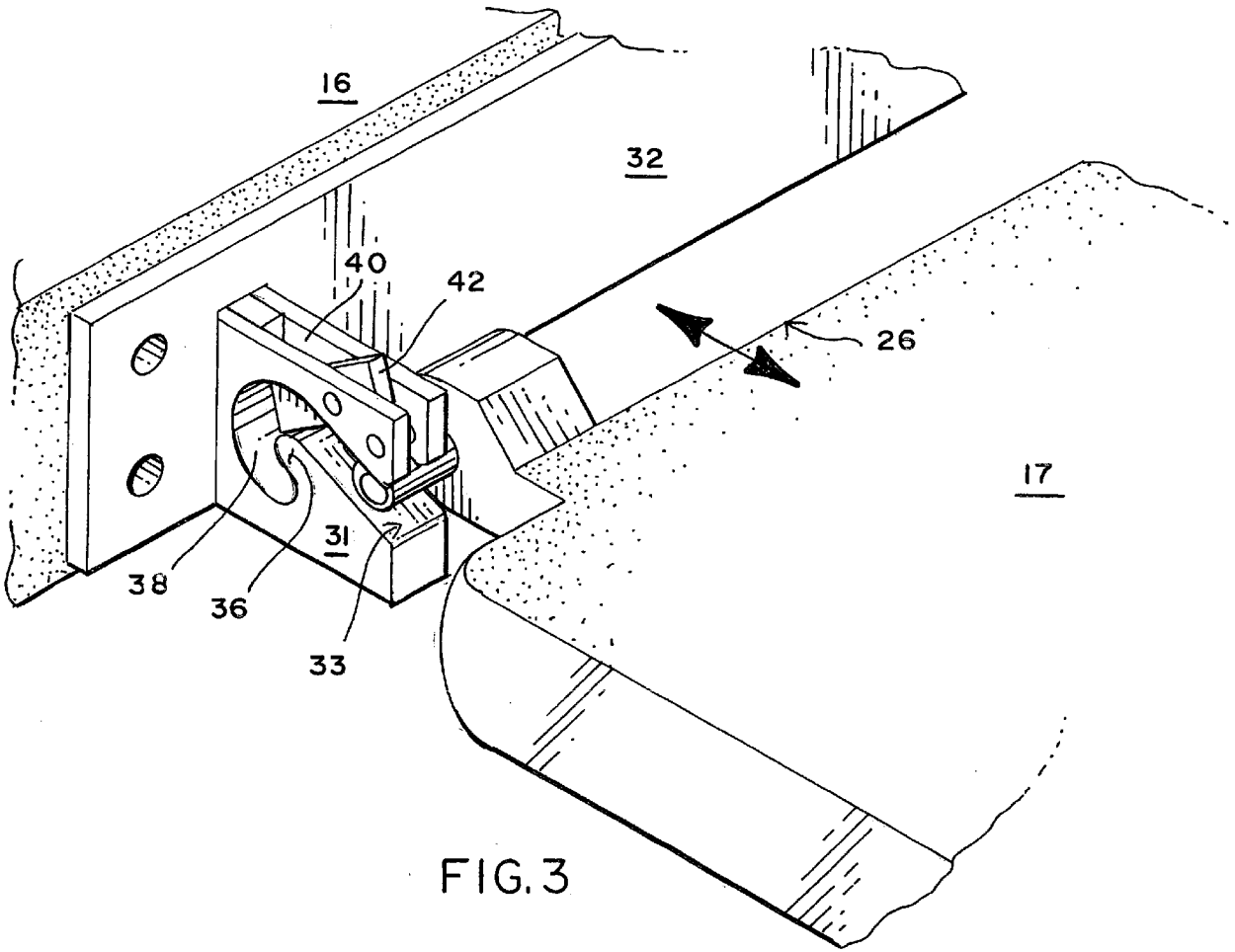
FIG. 3 is an enlarged perspective view of the anchoring system of FIG. 1 showing initial engagement of a seat assembly to a fixed console of a gaming station.
Figure 5:
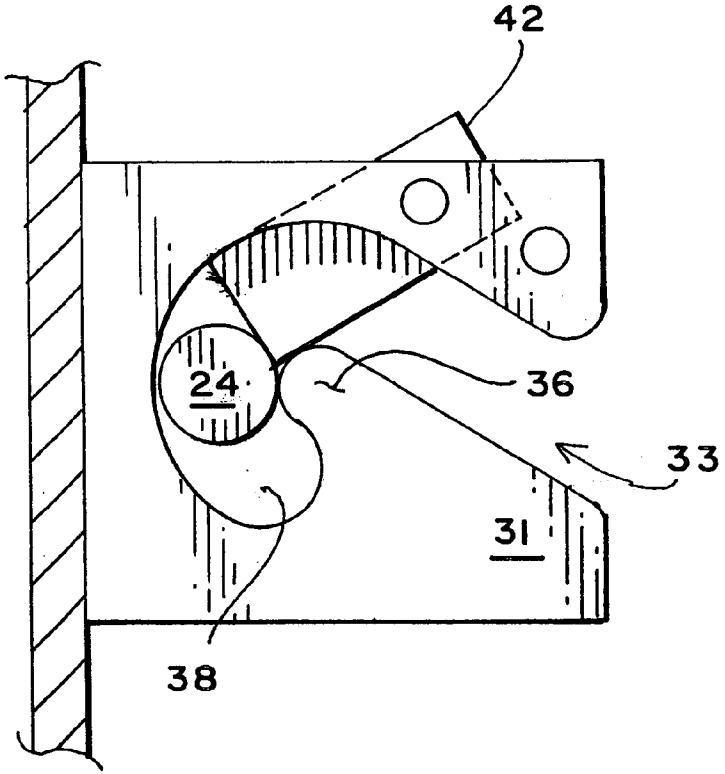
FIG. 5 is an enlarged side view of the anchoring system of FIG. 4 showing completion of engagement of each of the components of the anchoring system.
Figure 4:
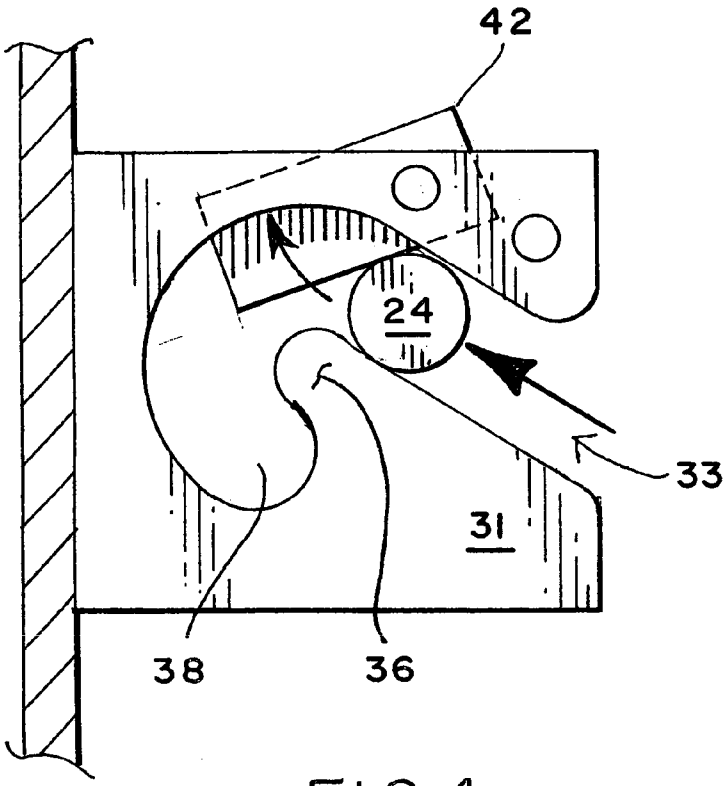
FIG. 4 is an enlarged side view of the anchoring system of FIG. 3.

The pin assembly (10), shown in FIG. 2, comprises means for attachment (22, 22') of the pin assembly (10) to the sled and a horizontally disposed pin. The pin assembly (10) is mounted on the forward or leading edge (26) of the sled (17) so as to provide, when engaged by the latch assembly (12), for proper and secure positioning of the seat assembly (14), relative to the console (16) of a gaming station. It is noted that in the embodiment of the invention shown in FIG. 1, the leading edge (26) of the sled (17) is provided with two pin assemblies (10, 10'), however, there is no compelling reason in the use of two pins, and one or three pins may be equally efficacious.

As shown in FIG. 2, axial movement of the sled (17) relative to the fixed console (16) of a gaming station, in the direction indicated by the arrow, is required to engage the pins (24, 24') of each of the two pin assemblies (10, 10'), on the leading edge (26) of the sled (17), with the complimentary latch assemblies (12, 12') on the console (16) of a gaming station. It is important to appreciate, that no tools or other implements are needed, or required, to align these components to one another; nor does their installation require any special skill or training. In the embodiment of the invention shown in FIG. 2, the leading edge (26) of the sled (17) has been slightly modified, by removal of a portion thereof (28) immediately behind each pin assembly (10, 10') so as to avoid interference with the mating of the pin (24, 24') and the snare (38, 38') latch assembly. The removed portion, or recess (28), in the leading edge (26) of the sled (17) is approximately equal in its overall dimensions to the length and width of latch assembly (12, 12') that projects from the console (16) of the gaming station.

This above arrangement is simply a design preference necessitated by the mounting of each of the pin assembly (10, 10') inboard from the sled's lateral edge. Obviously, if the pin assemblies (10, 10') are mounted at each of the corners of the lead edge, no such modification of the sled is necessary.

The latch assembly (12, 12') of the anchoring system of this invention, illustrated in FIGS. 2, 3, 4 & 5, comprises a mounting bracket (32) for securely affixing the latch assemblies (12, 12') to the fixed console (16) of a gaming station. In the embodiments of the invention illustrated in the above Figures, the functional components of the latch assembly (12) comprising an open or cage-like frame (31, 31'), having an open ramp (33, 33') comprising a riser (34, 34'), a crest (36, 36') at the end of the riser (34) and a snare (38, 38'). A slot (40, 40') is provided in the cage (31) above the riser (34) of the ramp (33) for pivotally mounting a brake (42, 42'). In operation of the anchoring device of this invention, the pin (24), which is mounted on the lead edge (26) of a sled (17), is advanced in the direction indicated by the arrow (FIG. 4) until such time as the pin (26) engages the ramp (33). Continued forward movement of the sled (17) causes the pin (26) to ride up the ramp (33) along the riser (34) and over the crest (36) of the riser (34), whereupon its forward motion is arrested by the snare (38) at the end of the ramp (33).

The forward movement of the pin (24) along the ramp (33) also causes displacement of the brake (42), in the direction indicated by the smaller arrows (FIG. 4), which is pivotally mounted above the riser (34) of the ramp (33). As the pin is advanced over the crest (36) of the riser (34) and into the snare (38), the brake (42) is first displaced upward and then released, whereupon it returns to its original position so as to lock the pin within the snare. The seat assembly (14) is now securely affixed to the console (16) of the gaming station. When the seat assembly (14) is in need of refurbishing, cleaning, and the like, the anchoring system of this invention permits disengagement thereof from the gaming station, by simply releasing the brake and reversing the engagement process.

The foregoing is intended as illustrative of the scope of this invention and not intended to delineate the scope thereof, which has been reserved for the claims that follow.

What is claimed is:

1. In a cantilever anchoring system for releasably interlocking a seat assembly to a fixed console of a work or gaming station, said seat assembly comprising a seat member and a sled member having a lead edge, the improvement comprising:

A. a pin assembly mounted to said lead edge comprising a pin support means and a pin extending from said pin support means, whereby said pin support means provides for orientation of said pin relative a complimentary latch assembly, so as to permit engagement of said pin by said latch assembly; and B. said latch assembly comprising a latch support means and an open housing, whereby said latch support means provides for orientation thereof relative to a complimentary pin assembly, so as to permit engagement of said pin by said latch assembly, said open housing of said latch assembly comprising pin engagement means, including an open ramp comprising a riser, a crest, a snare and a brake, said ramp of said open housing being configured to receive and guide said pin along said ramp, and said snare being configured to retain said pin upon advancement thereof subsequent to advancement of said pin along and over said crest of said ramp, and said brake of said open housing being pivotally mounted above said ramp, to secure said pin within said snare upon advancement of said pin along and over said crest of said ramp.

2. The improved anchoring system of claim 1, wherein said pin support means includes means for attachment of said pin assembly to either a seat assembly or to a fixed console of a work and/or gaming station.

3. The improved anchoring system of claim 1, wherein said latch support means includes means for attachment of said latch assembly to a fixed console of a work and/or gaming station.

4. The improved anchoring system of claim 1, wherein said pin support means is an integral part of said seat assembly.

5. The improved anchoring system of claim 1, wherein said latch support means is an integral part of a fixed console of a work and/or gaming station.

6. In a work or gaming station having a fixed console and a seat assembly releasably connected to said fixed console, the improvement comprising:

A. an anchoring system for releasably interlocking a seat assembly to a fixed console of a work or gaming station in a cantilever relationship so as to permit rearward raising and lowering of said seat assembly when said assembly and fixed console are interlocked comprising:

(1) a pin assembly comprising a pin support means and a pin extending from said pin support means, whereby said pin support means provides for orientation of said pin relative a complimentary latch assembly, so as to permit engagement of said pin by said latch assembly; and (2) said latch assembly comprising a latch support means and an open housing, whereby said latch support means provides for orientation of said latch relative to a complimentary pin assembly, so as to permit engagement of said pin by said latch assembly, said open housing of said latch assembly comprising pin engagement means, including an open ramp comprising a riser, a crest, a snare and a brake, said ramp of said open housing being configured to receive and guide said pin along said ramp, and said snare being configured to retain said pin upon advancement thereof subsequent to advancement of said pin along and over said crest of said ramp, and said brake of said open housing being pivotally mounted above said ramp, to secure said pin within said snare upon advancement of said pin along and over said crest of said ramp, and B. means for attaching each of said complimentary latch and pin assembly components to each of said fixed console and said seat assembly.

7. The improved anchoring system of claim 6, wherein said pin support means is an integral part of either a seat assembly or a fixed work and/or gaming station.

8. The improved anchoring system of claim 6, which said latch support means is an integral part of either a seat assembly or a fixed work and/or gaming station.

9. The improved anchoring system of claim 6, wherein the releasable interlocking of said seat assembly to said fixed console is defined by said cantilever relationship while said pin and latch assembly components inhibit removal of said assembly from said fixed console.

* * * * *